United States Patent [19]

Armstrong

[11] 4,134,237

[45] Jan. 16, 1979

[54] MODULAR SECTION MAST

[75] Inventor: James E. Armstrong, Crosby, Tex.

[73] Assignee: Pool Company, Dallas, Tex.

[21] Appl. No.: 816,675

[22] Filed: Jul. 18, 1977

Related U.S. Application Data

[63] Continuation-in-part of Ser. No. 710,386, Aug. 2, 1976, abandoned, which is a continuation of Ser. No. 557,824, Mar. 12, 1975, abandoned, and Ser. No. 431,571, Jan. 7, 1974, abandoned.

[51] Int. Cl.[2] ..... E04H 12/34

[52] U.S. Cl. ..... 52/118; 52/632; 52/745

[58] Field of Search ..... 52/115–121, 52/745, 632

[56] References Cited

U.S. PATENT DOCUMENTS

| | | | |
|---|---|---|---|
| 2,331,558 | 8/1957 | McEwen et al. | 52/121 |
| 2,508,835 | 5/1950 | Moon et al. | 52/118 X |
| 2,565,777 | 8/1951 | Moon | 52/115 |
| 2,690,268 | 9/1954 | Woolslayer et al. | 52/117 |
| 3,016,992 | 1/1962 | Wilson | 52/121 |

FOREIGN PATENT DOCUMENTS

| | | | |
|---|---|---|---|
| 272609 | 1/1965 | Australia | 52/118 |
| 815733 | 4/1937 | France | 52/118 |
| 875663 | 8/1961 | United Kingdom | 52/632 |

*Primary Examiner*—Alfred C. Perham
*Attorney, Agent, or Firm*—Richards, Harris & Medlock

[57] ABSTRACT

A multiple section mast having telescoping modular sections adapted to be erected at remote land sites or on offshore platforms by small capacity cranes. A separate lower mast section having an open side is first placed in vertical position on a substructure. A separate upper mast section is moved horizontally into the lower mast section then elevated vertically to extend above the lower mast section. A separate intermediate mast section having at least part of one side open is then moved horizontally into the lower mast section and fastened to the lower end of the upper mast section. The upper and intermediate mast sections are then simultaneously elevated until the lower end of the intermediate mast section can be fastened to the upper end of the lower mast section. Retainer means removably attached to the lower mast section extend into the open side engaging the upper and intermediate sections as they are telescoped.

15 Claims, 7 Drawing Figures

MODULAR SECTION MAST

RELATED APPLICATIONS

This is a continuation-in-part of prior continuation application Ser. No. 710,386, filed Aug. 2, 1976 now abandoned, which was a continuation of abandoned continuation application Ser. No. 557,824, filed Mar. 12, 1975, and abandoned application Ser. No. 431,571, filed Jan. 7, 1974.

BACKGROUND OF THE INVENTION

This invention relates to masts and methods for erecting masts, and more particularly to masts and methods of erecting masts on offshore drilling platforms or at remote land sites.

Different types of masts have been devised for use in drilling and workover of oil wells. In many applications, it is desirable for such masts to be portable from one well to the next, especially in offshore or remote area drilling. To meet this need, it has been the practice to make masts in telescoping sections which sections can then be extended one above the other to make a mast the desirable height.

Well known in the art are two section telescoping masts wherein the upper section is telescoped into the lower section and the entire assembly is transported from one location to the next. Such masts are transported horizontally to the erection site and the collapsed assembly is jackknifed into vertical position at which time the upper section is fully extended. A second type of portable mast involves the use of a three section mast where the intermediate section is telescoped within the lower section and the upper section is telescoped within the intermediate section. During transport from one location to the next, this type of mast is carried horizontally in collapsed form and upon arrival at a new location the collapsed mast is raised to a vertical position and fastened to a substructure. The upper and intermediate sections are then extended and fastened together to form a complete mast.

One problem typically encountered in offshore or remote area drilling is that only small capacity cranes are available for mast erection. In some instances cranes capable of handling only modest loads, on the order of 8,000 lbs., and capable of working at relatively low heights are available. Mast structures which telescope into a single assembly can exceed the weight and size limitations of the crane.

The most practical mast structure in offshore or remote area operations is one constructed of three separate sections of relatively modest size and weight. A mast formed of three separate modules provides a load which a small capacity crane can handle efficiently and an extended mast sufficiently tall to perform workover and drilling operations.

Multiple section modular masts are known in the art, but those currently in use are not easily erected on offshore platforms or at remote land sites. Some of these masts are only semimodular, one section is transported within the lower section and the third section is inserted within an opening in the lower section. Others require a more elaborate erection procedure such as jackknifing and in some, the height of the upper section which is inserted into openings in the lower section is severely limited.

Accordingly, a need arises for an improved vertically extensible telescoping mast having at least three separate sections each of which can be handled by a small capacity crane.

SUMMARY OF THE INVENTION

The present invention is directed to a telescoping modular mast which can be handled by a moderate capacity crane.

The mast is erected in modular mast sections. A lower section is placed in vertical position on a substructure and mounted thereto. An upper mast section having cross sections small enough to be passed into the open side of the lower section is horizontally moved into the lower section and vertically lifted until its lower end is adjacent the upper end of the lower mast section by a draw works. At least one intermediate mast section is then moved horizontally into the lower mast section and fastened to the lower end of the upper mast section. By means of a draw works, the upper and intermediate sections are simultaneously elevated until the lower end of the intermediate mast section is adjacent the upper end of the lower mast section. Removable retainer means are attached to the lower mast section which extend within the open side to engage guide surfaces defined on the extending sides of the upper and intermediate sections as they are telescoped. The retainer means are removable to permit horizontal movement of an intermediate section to within the lower section, and prevent the intermediate section from falling out of the lower section when secured.

DESCRIPTION OF THE PREFERRED EMBODIMENT

Figure 1:
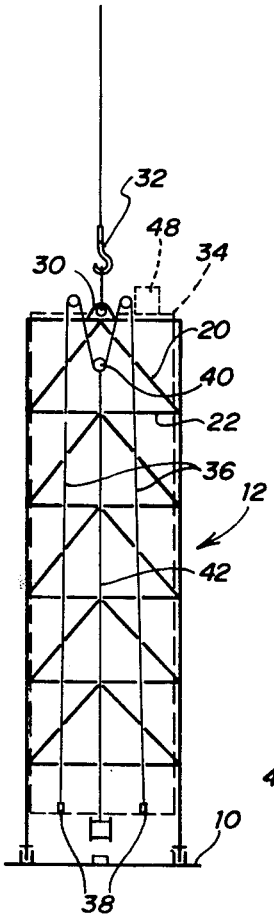
FIG. 1 is an elevational view in schematic form of the lower section of the mast with the upper section placed therein.

Referring to the drawings there is shown a mast structure 11 mounted on a substructure 10. The mast is of the type used in drilling and workover of oil wells. The mast structure primarily comprises modular lower, intermediate and upper mast sections 12, 53 and 34, respectively. Each of the sections are of a size, shape and height which permit the individual handling of the sections by a small capacity crane. As detailed more fully below, the upper and intermediate sections are dimensioned to be placed one at a time within the open side of the lower section then vertically raised to form a fully extended mast.

Figure 4:
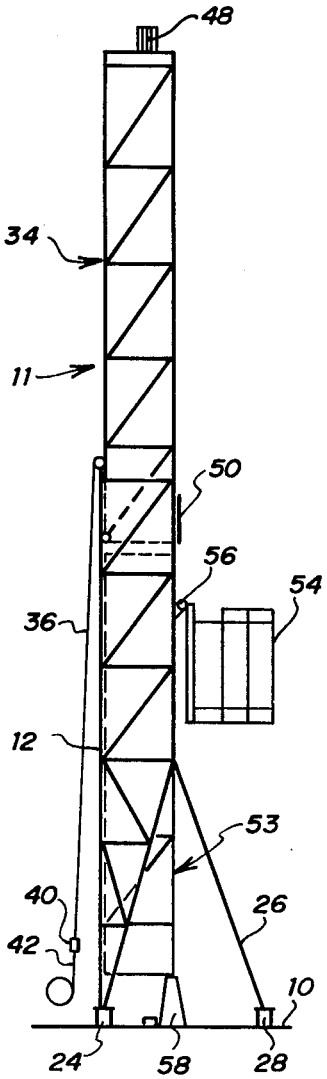
FIG. 4 is a view similar to FIG. 1 with the upper and intermediate sections in place.
Figure 7:
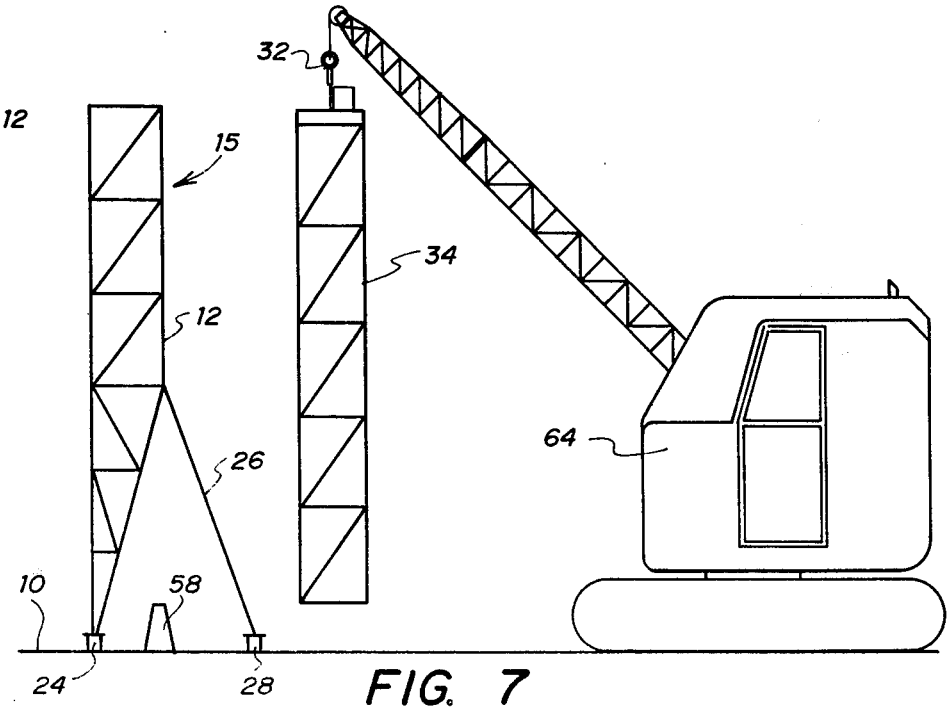
FIG. 7 is a schematic side elevational view of the lower section with the upper section being moved horizontally into the lower section by means of a crane.

Referring to FIGS. 1, 4 and 7, the substructure 10 is shown, which may be a foundation on the ground, a truck bed, an offshore platform on the deck of a ship or barge. Lower mast section 12 is supported by the substructure 10. Lower mast section 12 is U-shaped in cross section and has a longer side 14, shorter sides 16 and 18 and an open side 15. Sides 14, 16 and 18 are formed from structural trusses, for example, of structural steel members 20 and 22. Open side 15 of the lower mast section 12 is opposite to the side 14 and contains no structural members spanning the space between side 16 to side 18. Lower section 12 is lightweight enough to be efficiently handled by a small capacity crane, yet tall enough to combine with the upper and intermediate sections to form a fully extended mast high enough to perform necessary workover or drilling operations. In the preferred embodiment, the intermediate and upper sections described in more detail below have roughly the same dimensions and weight and thus are handled with equal ease by a small capacity crane.

An eye 30 is provided at the upper end of lower mast section 12, for attachment of a hook 32 of a crane as shown in FIGS. 1 and 7. The crane 64 is used to move the lower mast section into position for mounting on substructure 10.

As best seen in FIGS. 3, 4, 5 and 7 the lower end of the lower mast section 12 is pinned to the substructure at 24. In the embodiment shown, an A-frame comprising legs 26 supports the mast structure at 28. Other support structures may also be used.

Figure 3:
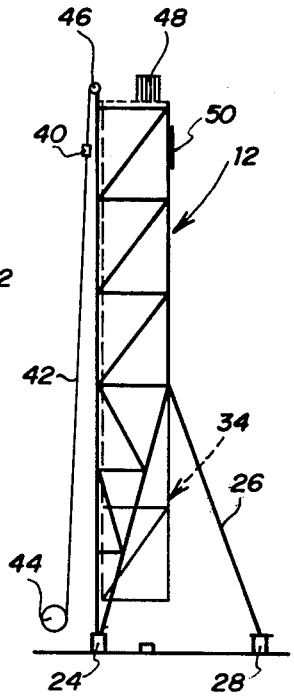
FIG. 3 is a schematic left side elevational view of the mast section of FIG. 1 with the upper section placed therein.
Figure 2:
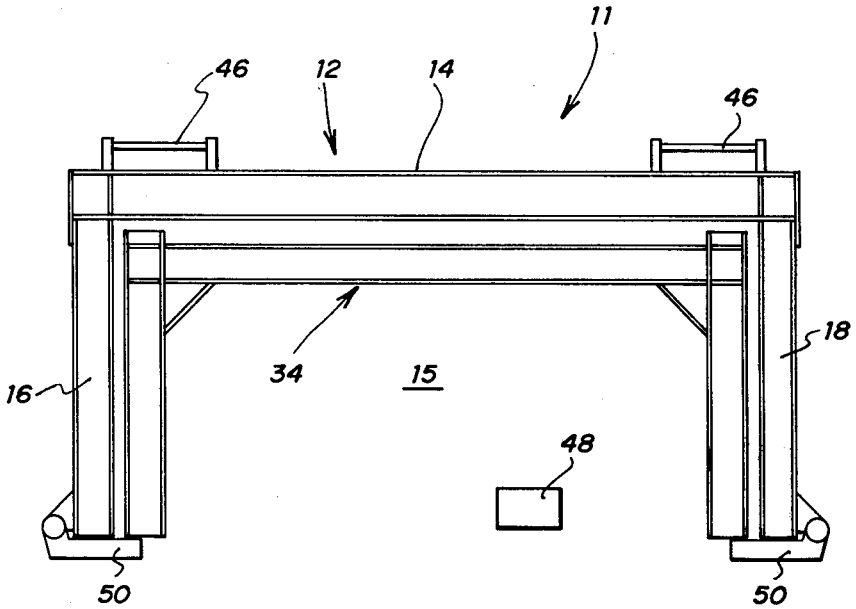
FIG. 2 is a schematic plan view of the mast sections of FIG. 1.

FIGS. 1, 2 and 3 show the upper mast section 34 telescopically received within the lower mast section 12. The upper mast section 34 is also of U-shape in cross-section, but may be closed on all four sides. Section 34 is supported in the position shown in FIGS. 1 and 2 by means of the raising line 36 attached to the lower end of the upper mast section at 38. The raising line 36 passes around the toggle block 40 to which a pulling line 42 is connected. As best shown in FIG. 3, the pulling line 42 is wound on a drum 44 by a power means, such as the drilling rig draw works. At the upper end of the lower mast section 12, a pair of pulleys 46 are mounted to carry the raising line 36. On top of the upper mast section is mounted a conventional crown block 48.

FIG. 2 shows removable retainer plates 50 attached to the vertical members of the lower mast section 12 adjacent its upper end, which act as a guide to retain the upper and intermediate mast sections within the lower mast section during extension. When a pulling force is exerted on the pulling line 42, so that the upper or intermediate mast sections are raised vertically, the removable retainer plates 50 prevent the upper or intermediate mast section from swinging outwardly from the lower mast section. Removable retainer plates 50 extend partially into the open side 15 to facilitate the extension of the upper and intermediate mast sections within the lower sections. After the upper mast section is extended above the lower mast section, the retainer plates 50 can be removed so that the intermediate section can be placed within the lower section.

The use of U-shaped sections and the removable retaining plates of the present invention provide significant advantages in operations where only small capacity cranes are available, such as on offshore platforms or at remote land sites. Telescoping masts presently in use have retaining means which are not removable and some require horizontal assembly of the upper mast sections within the lower section and the handling of all sections as a complete assembly. In the present invention, the lower section has one side which completely opens to permit individual handling of mast sections and the vertical extension of a mast which is extremely important when working offshore.

The upper mast section 34 is dimensioned so that it will fit within lower mast section 12. In the preferred embodiment, upper mast section 34 is dimensioned slightly smaller than the inside of the lower mast section so that the upper mast section will have the largest possible cross-section and therefore maximum structural integrity, yet fit within the lower mast section in telescoping relationship. The size and weight of the upper mast section enable it to be lifted and horizontally moved to within the lower mast section by a small capacity crane. Once the upper mast section 34 has been moved into this position, the raising line 36 can be attached. A pulling force is applied through the pulling line 42 to elevate the mast section 34 to the position shown in FIG. 4.

Once the upper section 34 is in the position illustrated in FIG. 4, an intermediate mast section 53 may then be moved horizontally by the crane into the lower section 23 below the upper section 34. Since the intermediate section is only telescoped within the lower section, it may be dimensioned so as to have substantially the same cross-section as the upper section. This is a significant structural advantage over telescoping masts currently in use in which each successively higher section must be smaller in cross-section so that the entire mast is collapsible into a unitary assembly.

The inner surfaces of the lower section 12 and the removable retainer plates 50 cooperatively receive the outer surfaces of upper and intermediate sections 34 and 53 in sliding engagement to permit the upper and intermediate sections to be vertically extended from the lower mast section.

Figure 5:
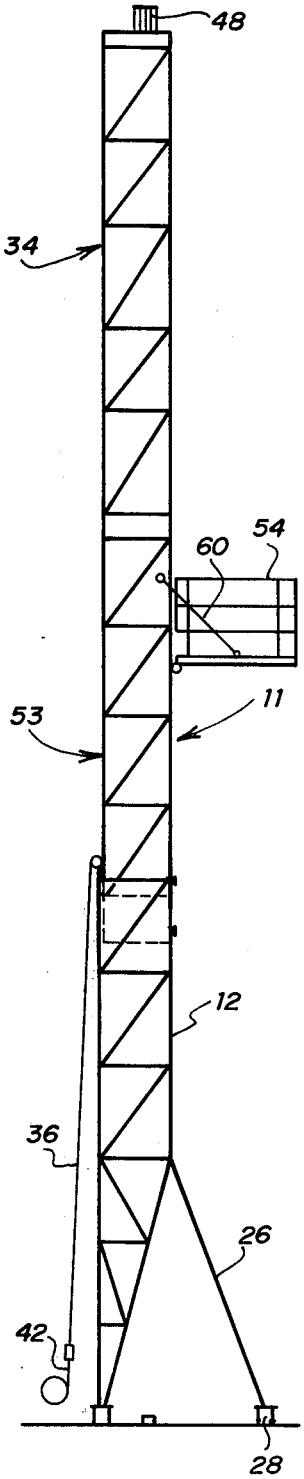
FIG. 5 is a view simliar to FIG. 1 with the mast shown fully erected.
Figure 6:
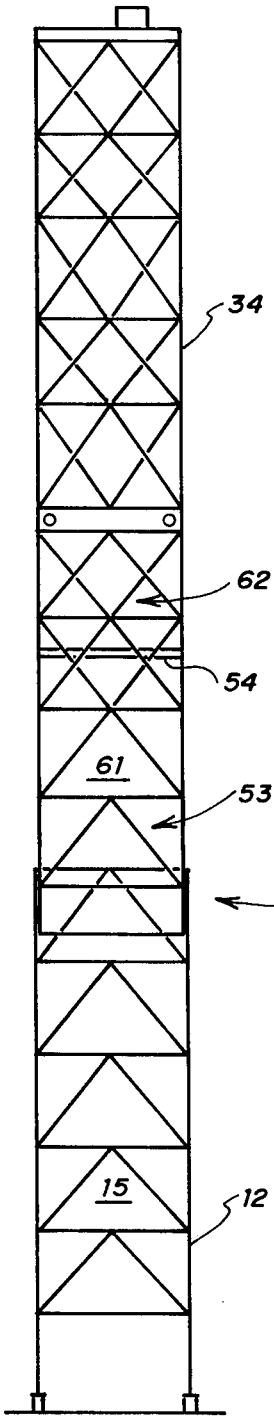
FIG. 6 is a schematic elevational front view of the fully erected mast shown in FIG. 5 wherein the side of the intermediate section congruent to the open side of the lower section is open up to the racking board.

In the preferred embodiment shown in FIGS. 5 and 6, intermediate section 53 is provided with a conventional racking board 54 which is doubly pivoted in both horizontal and vertical planes so that it may be swung to within the intermediate section 53 during the elevating operation. FIG. 5 shows the racking board extended from a horizontal pivot 56, in a position exterior to the intermediate section 53. The vertical pivot which allows the racking board to swing into the mast is not shown.

In the preferred embodiment, the upper and intermediate sections have roughly the same length as the lower mast section. By using modules of approximately the same size, the gross weight of the entire mast can be distributed in roughly three equal loads for maximum handleability. For example, in one embodiment successfully reduced to practice, a lower mast section measuring 41.75 feet in length, an intermediate mast section 31.0 feet and an upper mast section 37.33 feet are used to construct a complete mast 99.5 feet high which is capable of supporting more than 560,000 pounds and withstanding wind forces up to 70 knots.

It will also be apparent, however, that the upper section is not limited in height to the dimensions of the lower section. In some applications it may be desirable to use an upper section which is substantially higher than the lower mast section. This is possible in the present invention, but not in masts currently in use where the lower mast sections are not completely open on one side.

In the embodiment of the invention shown in FIG. 4, the intermediate section is placed on a pedestal 58 which supports the section just below the lower end of the upper section 34. However, the intermediate section could be placed on a substructure without intervention of the pedestal 58.

Once the intermediate section has been positioned into the lower section, the pulling line 42 is operated to lower the upper mast section into engagement with the intermediate section. These structures are then bolted or otherwise fastened together. The ends of the raising line 36 are then moved to a point of attachment at the lower end of the intermediate section 53. Power is supplied again to the pulling line to elevate both the intermediate and upper sections to the position shown in FIG. 5. The lower end of the intermediate mast section is then bolted or securely fastened to the upper end of the lower mast section. The racking board is pivoted out and upwardly into position and fastened into place by the support members 60. The raising lines 36 may be removed and the mast is ready for operation.

FIG. 6 shows the mast fully erected. The open side 15 of the lower mast section is completely open along the length of the lower mast section. Intermediate section 53 also has an open section 61 in the same plane as the open side of the lower section up to at least the point where the racking board 54 is pivoted, above which the upper part 62 of intermediate section 53 can be closed by structural trusses 20, 22, etc. Having an open side along the length of the lower section and along part of the length of the intermediate section allows the pipe and lines to be moved within the mast as is necessary for drilling and workover operations. This is especially critical in the three section mast where the racking board is pivoted from the intermediate section.

FIG. 7 shows the lower mast section positioned on a substructure. Approaching the open side 15 of the lower mast section is a crane 64 from which is suspended upper mast section 34. Note that the removable retainer plates 50 have been removed until such time as the intermediate mast section 53 is placed within the lower mast section 12. At that time the plates will be mounted on the lower mast section to guide the movement of the intermediate mast section to the top of the lower mast section. They will then be removed to permit the intermediate mast section to be placed within the lower mast section by a crane 64 in the same manner as the upper mast section was placed within the lower mast section.

It will be apparent that the mast is readily disassembled by merely reversing the steps just described.

Many modifications of this invention will be apparent to those skilled in the art. For example, a single length hydraulic cylinder could be used to elevate each of the mast sections. The preferred embodiment discloses a three section mast, but four or more section mast could be constructed using two or more intermediate sections as necessary to obtain adequate height or to reduce the weight of the sections without any change in cross-sectional dimensions, depending upon the available lifting capacity. The invention is not, therefore, limited to the specific embodiment shown and described, but only as defined by the accompanying claims.

What is claimed is:

1. An oil well drilling and workover mast for erection on a substructure at remote sites, the mast having an open side along the lower section and being open on the same side at least a portion of the intermediate sections whereby pipe and drilling equipment may be moved within the mast comprising:

separate upper and lower mast sections and one or more intermediate mast sections;

said lower mast section having three truss sides and an open side, said open side open along the entire length of said lower mast section whereby pipe and drilling equipment longer than said lower section can be moved within said section over a well or away from a well in vertical position;

said intermediate mast sections dimensioned to substantially conform to the inside dimensions of said lower mast section, said intermediate sections being dimensioned small enough in horizontal cross-section whereby said intermediate mast sections can be moved to within the open side of said lower section and extended from within said lower section to raise said intermediate sections to a level such that said lower end of the lower of said intermediate sections is adjacent to said upper end of said lower section, the lower portion of said intermediate sections also having one side open along its lower portion, and said intermediate sections also having guide surfaces on the ends of the extending sides thereof;

said upper mast section dimensioned to conform substantially to the inside dimensions of said lower mast section, said upper mast section resting on and releasably fastened to said intermediate mast sections and having substantially the same cross-section, said upper mast section being dimensioned small enough in constant horizontal section whereby said upper mast section can be moved to within the open side of the lower section and extended from within said lower section to a raised position whereby the lower end of said upper section is at a sufficient height to allow one of said intermediate sections to pass through the open section of said lower section and be positioned under said upper section and fastened to said upper section, said upper section also defining guide surfaces on the ends of the extending sides thereof;

a draw works in a raising line for telescoping said upper mast section from within said lower mast section in a vertical direction and then telescoping said intermediate sections with said upper section fastened thereto from within said lower mast section;

retaining means removably attached to said lower mast section to extend into said open side of said lower mast section a limited distance for engaging the guide surfaces of said upper and intermediate mast sections as they are being telescoped from said lower section, said retaining means being attached to said lower mast section to extend into said open side of said lower mast section a distance sufficient to engage said upper and intermediate mast sections as they are telescoped, said retaining means having limited extension into said open side to provide clearance for pipe and drilling equipment to be moved within the mast over the well in vertical position; and a racking board horizontally pivoted from said intermediate section to allow pipe racking.

2. An oil well drilling and workover mast for erection on a substructure at remote sites, the mast having an open side along the lower section and being open on the same side at least a portion of the intermediate sections whereby pipe and drilling equipment may be moved within the mast comprising:

separate upper, intermediate and lower mast sections;

said lower mast section having three truss sides and an open side, said open side open along the entire length of said lower mast section whereby pipe and drilling equipment longer than said lower section can be moved within said section over a well or away from a well in vertical position;

said intermediate mast section having its lower end fastened to the upper end of said lower mast section and being dimensioned small enough in horizontal section whereby said intermediate mast section can be moved to pass through the open side of said lower section and extended from within said lower section to raise the intermediate section to a level such that said lower end of said intermediate section is adjacent to said upper end of said lower section;

said upper mast section resting on and releasably fastened to said intermediate mast section, said upper mast section being dimensioned small enough in horizontal section whereby said upper mast section can be moved to pass through the open side of the lower section and extended from within said lower section to a raised position whereby the lower end of said upper section is at a sufficient height to allow said intermediate section to pass through the open section of said lower section and be positioned under said upper section and fastened to said upper section;

raising means for telescoping said upper mast section from within said lower mast section in a vertical direction and then telescoping said intermediate section with said upper section fastened thereto from within said lower mast section; and retaining means removably attached to said lower mast section to extend into said open side of said lower mast section for guiding said upper and intermediate mast sections as they are being telescoped from said lower section, said retaining means being attached to said lower mast section to extend into said open side of said lower mast section a distance sufficient to engage said upper and intermediate mast sections as they are telescoped, said retaining means having a limited extension into said open side to provide clearance for pipe and drilling equipment to be moved within the mast over the well in vertical position after assembly of said sections.

3. The modular mast as defined in claim 2 wherein a racking board extends from said intermediate section and said retainer means extends only a limited distance into said open side to provide clearance for said racking board during telescoping and to allow pipe racking once the mast is assembled.

4. The modular mast as defined in claim 2 wherein said upper and intermediate sections have substantially similar cross-sections.

5. The modular mast as defined in claim 2 wherein the cross-section of said upper and intermediate mast sections is constant along their lengths.

6. The modular mast as defined in claim 2 wherein the raising means includes a draw works in a raising line.

7. The modular mast as defined in claim 2 wherein said intermediate section is open on one side at least along the lower portion of said intermediate mast section.

8. The modular mast as defined in claim 3 wherein said intermediate section is open along one side at least up to said racking board.

9. The modular mast as defined in claim 2 wherein said upper mast section has greater length than said lower mast section.

10. The modular mast as defined in claim 2 wherein said lower section has rectangular cross-section.

11. The modular mast as defined in claim 2 wherein said upper and intermediate cross-sections substantially conform with the inside dimensions of said lower mast section to fit in telescoping relationship within said lower section and to be guided by guide surfaces on the exterior of said intermediate and upper sections and on the interior of said lower section.

12. The modular mast as defined in claim 2 wherein guide surfaces are formed on the extending sides of said upper and intermediate mast sections and wherein said retaining means engages the guide surfaces during telescoping of the mast sections.

13. The modular mast as defined in claim 12 wherein said guide surfaces are on the ends of the extending walls of said upper and intermediate mast sections.

14. A method of erecting an oil well drilling and workover mast comprising:

placing a lower mast section in vertical position on a substructure;

moving an upper mast section in upright position horizontally to within the lower mast section;

raising the upper mast section vertically within said lower mast section until its lower end is adjacent the upper end of the lower mast section;

moving an intermediate section in upright position having a racking board horizontally pivoted therefrom to a position within the lower mast section and below the upper mast section;

fastening the lower end of the upper mast section to the upper end of the intermediate mast section;

simultaneously raising the upper and intermediate mast sections with a racking board horizontally pivoted therefrom until the lower end of the intermediate mast section is adjacent the upper end of the lower mast section; and fastening the lower end of the intermediate mast section to the upper end of the lower mast section.

15. The method for erecting a modular mast as defined in claim 14 further comprising:

moving sections of pipe and drilling equipment longer than said lower mast section into said mast in vertical position through the open side thereof.

* * * * *

UNITED STATES PATENT AND TRADEMARK OFFICE

CERTIFICATE OF CORRECTION

PATENT NO. : 4,134,237
DATED : Jan. 16, 1979
INVENTOR(S) : James E. Armstrong

It is certified that error appears in the above-identified patent and that said Letters Patent are hereby corrected as shown below:

Column 4, line 22, change "23" to --12--.

Signed and Sealed this

Fifth Day of June 1979

[SEAL]

*Attest:*

RUTH C. MASON
*Attesting Officer*

DONALD W. BANNER
*Commissioner of Patents and Trademarks*